US005747114A

United States Patent [19]

Stegen et al.

[11] Patent Number: 5,747,114

[45] Date of Patent: May 5, 1998

[54] PROCESS FOR THE EFFECT COATING OF GRAINED PLASTICS PARTS

[75] Inventors: Helga Stegen, Wuppertal; Joachim Blum, Remscheid; Klaus-Günter Kerlin, Haan, all of Germany

[73] Assignee: Herberts Gesellschaft mit beschrankter Haftung, Wuppertal, Germany

[21] Appl. No.: 710,476

[22] Filed: Sep. 18, 1996

[30] Foreign Application Priority Data

Sep. 23, 1995 [DE] Germany ..... 195 35 452.4

[51] Int. Cl.[6] ..... B05D 3/02; B05D 5/06

[52] U.S. Cl. ..... 427/380; 427/412.1

[58] Field of Search ..... 427/412.1, 412.3, 427/412.4, 412.5, 379, 380

[56] References Cited

U.S. PATENT DOCUMENTS

| | | | |
|---|---|---|---|
| 4,489,135 | 12/1984 | Drexler et al. | 427/407.1 |
| 4,948,829 | 8/1990 | Mitsuji . | |
| 5,011,881 | 4/1991 | Fujii . | |
| 5,169,922 | 12/1992 | Hille et al. | 528/75 |
| 5,242,751 | 9/1993 | Hartman . | |
| 5,556,912 | 9/1996 | Brock . | |

FOREIGN PATENT DOCUMENTS

| | | |
|---|---|---|
| 2068167 | 11/1992 | Canada . |
| 0 302 296 | 2/1989 | European Pat. Off. . |
| 0 379 158 | 7/1990 | European Pat. Off. . |
| 0 395 228 | 10/1990 | European Pat. Off. . |
| 4308859A1 | 9/1984 | Germany . |
| 3727081 | 2/1989 | Germany . |
| 3915459 | 11/1989 | Germany . |
| 4315467A1 | 11/1994 | Germany . |
| 4328092 | 2/1995 | Germany . |
| 4344063 | 6/1995 | Germany . |

*Primary Examiner*—Erma Cameron

*Attorney, Agent, or Firm*—Pillsbury Madison & Sutro LLP

[57] ABSTRACT

A process for the effect coating of polar plastics parts having a grained surface, characterised in that a) a first coating layer, which is free from effect pigments and modified polyolefines and which comprises a coating medium based on physically drying binder vehicle systems which contain one or more polyurethane resins and/or oligomeric urethanes and which do not chemically crosslink at the temperatures employed in process step f), is applied at a dry coat thickness of 5 to 40 μm, b) is dried at 20° to 80° C. down to a residual content of 3 to 20% by weight of the volatile fractions which are contained in the applied coating film at the temperature employed, c) is overcoated wet-into-wet with an effect base lacquer, d) is dried at 20° to 80° C. down to a residual content of 3 to 20% by weight of the volatile fractions which are contained in the applied coating film at the temperature employed, e) is overcoated wet-into-wet with a liquid clear lacquer which chemically crosslinks with the formation of covalent bonds at the drying temperatures employed in process step f), and f) the three coating layers which are obtained are jointly dried or hardened at temperatures of 60° to 110° C.

11 Claims, No Drawings

PROCESS FOR THE EFFECT COATING OF GRAINED PLASTICS PARTS

FIELD OF THE INVENTION

This invention relates to a process for producing effect coatings on polar, grained plastics parts.

BACKGROUND OF THE INVENTION

In the automobile industry, plastics parts such as bumpers, spoilers, hub caps or mirror housings for example, are extensively mounted on the bodywork. If these plastics parts consist of nonpolar polyolefine plastics, such as polypropylene or blends thereof for example, and if they are coated, it is necessary to prepare the surfaces of the plastics, which are intrinsically nonpolar, for coating in order to ensure the requisite adhesion of the lacquer coat. Various methods have thus become known, the purpose of which is to create a polar surface for the subsequent coating operation. Examples of methods of this type include physical and chemical methods of treatment such as flame-treatment or UV irradiation of the plastics surfaces or chemical modification with aggressive agents, such as sulphonation for example. Adhesion-promoting primer coats may also be applied, however. Primers which contain chlorinated polyolefines (CPOs) have proved particularly useful in practice.

If polar plastics are employed, such as polycarbonate for example, the labour-intensive preparation of the surface of the plastic by physical and chemical methods before the coating operation can be omitted. Moreover, it is not necessary to apply a primer coat.

In the ideal case, the plastics parts to be coated possess a smooth, glossy surface. However, for reasons of an efficient working procedure on an assembly line, one and the same plastics part is frequently mounted coated or uncoated, depending on the model of vehicle or the vehicle trim. For visual reasons, the uncoated plastics part has to have a surface which appears matt to an observer, in order visually to conceal scratches or contact marks of contact. This is effected by providing the surface of the plastics parts with a grain. The fineness of the grain is given in μm. Plastics parts which are particularly suitable and which are customary for parts mounted on vehicles are those with a grain of ≧10 μm, particularly those with a grain between 20 and 50 μm, for example. For reasons of simplicity of stockholding and of efficient production, plastics parts with only one type of surface structure are preferably used, for example solely parts with a 40 μm grain.

However, the overcoating of grained plastics parts of this type is problematical as regards effect formation and matching the colour to the colour of the bodywork, particularly in the case of effect coatings. Before the application of the effect-producing lacquer coat, which comprises an effect base lacquer, to the grained plastics part, a smoothing primer coat is therefore applied. When coating polar plastics parts, however, the use of these primers, which are not harmless on account of the organically bonded chlorine which they contain, can be dispensed with and the primer coat can be produced from less harmful materials. Chemically crosslinking lacquer systems are used in practice for this purpose. These are hardened after application to form a suitable primer coat for the covering coating to be applied subsequently, by drying at temperatures between 60° and 100° C., for example. Examples of chemically crosslinking lacquer systems which are suitable for the primer coating of plastics include two-component epoxide/amine systems and two-component polyurethane systems. After the application and hardening of these primers, the decorative coating, which generally comprises a colour- or effect-producing base lacquer coat and a protective clear lacquer coat, can be applied.

SUMMARY OF THE INVENTION

The object of the present invention is to provide a process for producing effect coatings on grained plastics parts which overcomes the problems of the defective effect formation and the defective colour matching with the colour of the remaining parts of the bodywork and which can be carried out in an energy-saving manner.

This object is achieved by a process for the effect coating of polar plastics parts having a grained surface, characterised in that a) a first coating layer, which is free from effect pigments and modified polyolefines and which comprises a coating medium based on physically drying binder vehicle systems which contain one or more polyurethane resins and/or oligomeric urethanes and which do not chemically crosslink at the temperatures employed in process step f), is applied at a dry coat thickness of 5 to 40 μm, b) is dried at 20° to 80° C. down to a residual content of 3 to 20% by weight of the volatile fractions which are contained in the applied coating film at the temperature employed, c) is overcoated wet-into-wet with an effect base lacquer, d) is dried at 20° to 80° C. down to a residual content of 3 to 20% by weight of the volatile fractions which are contained in the applied coating film at the temperature employed, e) is overcoated wet-into-wet with a liquid clear lacquer which chemically crosslinks with the formation of covalent bonds at the drying temperatures employed in process step f), and f) the three coating layers which are obtained are jointly dried or hardened at temperatures of 60° to 110° C.

The drying operation in process steps b) and d) can be effected, for example, so that the duration of drying is 1 to 3 minutes. Drying is preferably effected down to a residual content of 5 to 15% by weight, most preferably 5 to 10% by weight, of the volatile fractions contained in the applied coating film at the temperature employed. In this respect, the operation is generally carried out so that drying of the first two coats, namely process steps b) and d), is effected under conditions of temperature and time which are below those of the joint drying or hardening of the three coats in process step f). Ventilation may optionally be effected after the application of the clear lacquer and before the joint drying or hardening of the three coating layers, namely between process steps e) and f). Ventilation may be effected at 20° to 30° C. for 1 to 3 minutes, for example.

DETAILED DESCRIPTION OF THE INVENTION

In the process according to the invention, serving as substrate are polar plastics different from pure olefin or diene polymers, such as polyamide, polyurethane, polycarbonate or polyester, for example, polybutylene terephthalate and corresponding blends. Plastics parts made of polyolefine plastics are unsuitable. In particular, the plastics parts are those which are used as mounting parts on vehicles, such as bumpers or spoilers. The plastics parts which are used in the process according to the invention have a grained surface, e.g. one with a 10 to 50 μm grain, preferably a grain larger than 20 μm.

In the process according to the invention, a lacquer coat of a coating medium which is free from pigment and extender or which is pigmented in a single colour is applied first, the binder vehicle basis of which lacquer coat comprises physically drying binder vehicle systems. In this connection, binder vehicle/crosslinking agent systems can also be used which are inherently capable of crosslinking with the formation of covalent bonds but which do not undergo chemical crosslinking under the conditions of drying or hardening which are employed in process step f) of the process according to the invention. Within the temperature range below 110° C. in particular, the binder vehicle systems exhibit no chemical reactivity. The crosslinking agents which can be used are those which are physically drying, film-forming systems under these conditions, e.g melamine resins. The coating medium is preferably derived from colour-imparting and/or effect-producing base lacquer coating media which are known in the art. The coating media may be formulated based on solvents, but they are preferably aqueous coating media, the binder vehicle systems of which are stabilised in a suitable manner, e.g. anionically, cationically or non-ionically.

The base lacquer coating media which can be used in process step a) of the process according to the invention, for example, are the usual lacquer systems which contain one or more customary base resins as film-forming binder vehicles. They may in fact contain crosslinking agents, but the latter exhibit no crosslinking effect in relation to the binder vehicles under the drying or hardening conditions of process step f). The base lacquer contains one or more polyurethane resins and/or oligomeric urethanes (oligo-urethanes) as film-forming binder vehicles (base resins), preferably in a proportion of at least 15% by weight with respect to the solid resin content of the base lacquer. Polyesters and/or (meth) acrylic copolymer resins are preferably used as additional film-forming binder vehicles.

The coating media may be customary single-colour base lacquer coating media such as those which are used in the coating of motor vehicles for the production of two-layer coatings of the base lacquer/clear lacquer type, or a coating medium may be used which is free from pigment and extender and which is based on the binder vehicle system or on the binder vehicle/crosslink agent system of a base lacquer coating medium. It is crucial that the coating media used in process step a) according to the invention contains no effect pigments and no modified polyolefines such as chlorinated polyolefines for example.

The coating medium which is applied in process step a) is preferably pigmented in a single colour, i.e. it is preferably a base lacquer which, in addition to the usual physically drying binder vehicles and crosslinking agents and/or binder vehicles and crosslinking agents which are inherently chemically crosslinkable, contains inorganic and/or organic coloured pigments, such as titanium dioxide, iron oxide pigments, carbon black, azo pigments or phthalocyanine pigments for example, but contains no effect pigments.

An example of a solvent-based base lacquer system which can be used in process step a) of the process according to the invention is to be found in EP-A-0 302 296.

Examples of preferred aqueous base lacquer systems and aqueous base lacquer binder vehicle systems which can be used in process step a) of the process according to the invention are to be found in DE-A-36 28 124, DE-A-40 25 264, EP-A-0 089 497, EP-A-0 379 158, EP-A-0 427 979, EP-A-0 512 524, EP-A-0 581 211, EP-A-0 584 818 and WO 95/16004.

In process step a) of the process according to the invention, the first coating layer is applied at a dry coat thickness of 5 to 40 μm, preferably between 20 and 30 μm, e.g. by spraying. In this connection, it is recommended that when the plastic substrate has a larger grain, the dry coat thickness of the first coating layer is selected to be within the upper range of the above values. In process step b), the first coating layer is dried at 20° to 80° C. down to a residual content of 3 to 20% by weight of the volatile fractions which are contained in the applied coating film at the temperature employed, for example over 1 to 3 minutes. Thereafter, in process step c) of the process according to the invention, it is overcoated by a wet-into-wet method, e.g. by spraying, with an effect base lacquer which is known in the art and which is based on organic solvents or which is preferably water-based, at a dry coat thickness of 10 to 30 μm for example, preferably between 15 and 25 μm.

The effect base lacquers which are known in the art comprise base lacquer coating media which are effect-producing and which are generally also colour-imparting, such as those which are used for the production of base lacquer/clear lacquer two-layer coatings, a large number of which is known from the patent literature, for example.

The effect base lacquers may be formulated based on solvents, but they are preferably aqueous effect base lacquers, the binder vehicles of which are stabilised in a suitable manner, e.g. anionically, cationically or non-ionically. In this respect, the binder vehicles may be physically drying binder vehicles, or may be binder vehicle/crosslinking agent systems which are inherently crosslinkable by the formation of covalent bonds, for example, but which undergo no chemical crosslinking under the forced drying conditions of process step f) of the process according to the invention. In particular, the binder vehicle systems exhibit no chemical reactivity in the temperature range below 110° C. The lacquer systems are the usual ones, which contain one or more customary base resins as film-forming binder vehicles. They may in fact contain crosslinking agents, but the latter exhibit no crosslinking effect in relation to the binder vehicles under the drying conditions of process step f). Polyesters, polyurethanes and/or (meth) acrylic copolymer resins can be used as film-forming binder vehicles (base resins), for example. The preferred aqueous effect base lacquers preferably contain polyurethane resins, most preferably in a proportion of at least 15% by weight with respect to the solid resin content of the aqueous effect base lacquer.

In addition to the usual physically drying and/or chemically crosslinking binder vehicle systems, the effect base lacquers which are used in process step c) of the process according to the invention contain effect pigments, such as metallic pigments for example, e.g. of titanium, aluminium or copper, interference pigments such as aluminium coated with titanium dioxide, for example, coated mica, graphite effect pigments, lamellar iron oxide or lamellar copper phthalocyanine pigments. In general they also contain colour-imparting inorganic and/or organic coloured pigments, such as titanium dioxide, iron oxide pigments, carbon black, azo pigments or phthalocyanine pigments, for example.

Moreover, the effect base lacquers may contain customary lacquer auxiliary substances, such as extenders, catalysts, levelling agents, anti-cratering agents or light stabilisers for example, optionally in combination with antioxidants.

Examples of solvent-based effect base lacquers and effect base lacquer systems which can be used in process step c) of the process according to the invention are to be found in DE-A-29 24 632, DE-A-42 18 106, EP-A-O 302 296, WO-91 00 895 and WO-95 05 425.

Examples of aqueous effect base lacquer systems which are preferably used in process step c) of the process according to the invention are to be found in DE-A-38 41 540, DE-A-41 22 266, EP-A-0 089 497, EP-A-0 287 144 and EP-A-0 427 979.

Examples of aqueous effect base lacquer systems which are most preferably used in process step c) of the process according to the invention are to be found in DE-A-36 28 124, DE-A-40 25 264, EP-A-0 379 158, EP-A-0 512 524, EP-A-0 581 211 and EP-A-0 584 818.

Different base lacquers can be used for the first and second coating layers produced by the process according to the invention, but similar base lacquers are preferably used. This is explained below.

For example, a solvent-based base lacquer, or preferably a water-thinnable base lacquer, can be used to produce the first coating layer. The same selection option exists for the second coating layer, but it is preferable to use either a solvent-based base lacquer or, most preferably, an aqueous base lacquer for each of the two coating layers. It is particularly preferred that the solid resin composition of the base lacquers which are used to produce the first and second coating layers is substantially the same, i.e. that these base lacquers have qualitatively the same solid resin composition (the same binder vehicles and optionally crosslinking agents are present), and that the quantitative composition of the solid resin merely has a range of variation which is less than 30% by weight, preferably less than 20% by weight, most preferably less than 15% by weight, with respect in each case to the relative proportion by weight of the individual binder vehicles and of the crosslinking agents which are optionally present. In addition it is preferred that the base lacquer which is used to produce the first coating layer has a neutral colour or a colour which approaches that of the effect base lacquer which is used to produce the second coating layer.

In process step d), the effect coat which is applied in process step c) of the process according to the invention is dried at 20° to 80° C. down to a residual content of 3 to 20% by weight of the volatile fractions which are contained in the applied coating film at the temperature employed, for example over 1 to 3 minutes. Thereafter, in process step e), it is overcoated, e.g. to give a dry coat thickness of 25 to 50 μm by a wet-into-wet method, e.g. by spraying, with a clear lacquer coating medium which is known in the art.

In principle, all known clear lacquers which chemically crosslink under the conditions of process step f) are suitable as clear lacquer coating media for producing the third coating layer. These may be single-component or preferably multi-component clear lacquer coating media. They may be solvent-based systems or may be water-thinnable clear lacquers, the binder vehicles of which are stabilised in a suitable manner, e.g. anionically, cationically or non-ionically. Water-thinnable clear lacquer systems may comprise water-soluble systems or systems dispersed in water, particularly emulsion systems. The clear lacquer coating media are chemical crosslinked with the formation of covalent bonds in process step f) of the process according to the invention.

The clear lacquers which can be used in the process according to the invention are customary clear lacquer coating media which contain one or more customary base resins as film-forming binder vehicles. If the base resins are not self-crosslinking, they also contain crosslinking agents. Both the base resin component and the crosslinking component are subject to no restriction, except that they must be chemically crosslinkable with each other under the conditions of process step f). Polyester, polyurethane and/or poly(meth)acrylate resins can be used as film-forming binder vehicles (base resins), for example. The selection of the crosslinking agents which the binder vehicles optionally contain is not critical. It depends on the functionality of the base resins, i.e. the crosslinking agents are selected so that they exhibit a reactive functionality which is complementary to the functionality of the base resins. Preferred examples of complementary functionalities such as these between the base resin and the crosslinking agents include: carboxyl/epoxide, (meth)acryloyl/CH-acid group, and preferably hydroxyl/free isocyanate. Provided that they are compatible with each other, a plurality of complementary functionalities such as these may also be present simultaneously in a clear lacquer. The crosslinking agents which the clear lacquers optionally contain may be present individually or in admixture.

In addition to chemically crosslinking binder vehicles and optionally crosslinking agents, the clear lacquers which can be used in the process according to the invention may contain customary lacquer auxiliary substances, e.g. catalysts, levelling agents and light stabilisers.

Examples of non-aqueous clear lacquer systems which can preferably be used as a clear lacquer in the process according to the invention are to be found in DE-A-40 17 075, DE-A-41 24 167, EP-A-0 318 800, EP-A-0 327 031 and EP-A-0 355 959.

Examples of aqueous clear lacquer systems which can preferably be used as a clear lacquer in the process according to the invention are to be found in DE-A-41 01 696, DE-A-42 03 510, EP-A-0 496 205, EP-A-0 469 210, EP-A-0 626 401 and EP-A-0 626 432.

The clear lacquer coat which is applied wet-into-wet in process step e) of the process according to the invention may optionally be ventilated for 1 to 3 minutes at 20° to 30° C. In the following process step f), the three coating layers are jointly dried, with chemical crosslinking of the outer clear lacquer layer, at temperatures between 60° and 110° C.

The process according to the invention permits the production of effect coatings on grained plastics parts in accordance with a wet-into-wet application of three coating layers, the three coating layers being dried jointly. In the course of this procedure, the outer clear lacquer layer is chemically crosslinked with the formation of covalent bonds. A good effect formation is obtained by the process according to the invention. The graininess of the surface of the plastic is levelled out. Differences in colour do not arise between the effect coated plastics parts produced by the process according to the invention and vehicle bodywork which is coated in the same effect colour. The process also has the advantage that it comprises few drying steps, so that it is not necessary to perform a plurality of energy-intensive drying and hardening steps.

EXAMPLE 1

Comparative Example

A plastic sheet of polycarbonate with a grain of 40 μm was spray-coated with a silver aqueous metallic base lacquer according to DE-A-42 24 617 to give a dry coat thickness of 20 μm. After drying for 3 minutes at 20° C., a commercially available two-component clear lacquer based on acrylate resin was overcoated by spraying to give a dry coat thickness of 35 μm. After forced drying for 30 minutes at 80° C., a metallic coating with impaired flop was obtained.

EXAMPLE 2

Comparative Example

A plastic sheet of polycarbonate with a grain of 40 μm was spray-coated with the silver metallic base lacquer from Example 1 to give a dry coat thickness of 20 μm. After drying for 3 minutes at 20° C., a further coat of the same metallic base lacquer was applied by spraying, likewise at a dry coat thickness of 20 μm. After drying for 3 minutes at 20° C., a commercially available two-component clear lacquer based on acrylate resin was overcoated by spraying to give a dry coat thickness of 35 μm. After forced drying for 30 minutes at 80° C., a metallic coating with impaired flop was obtained.

EXAMPLE 3

According to the Invention

A plastic sheet of polycarbonate with a grain of 40 μm was spray-coated with a single colour, aqueous base lacquer according to WO 95/16004, Example 4.2, to give a dry coat thickness of 20 μm. After drying for 3 minutes at 20° C., the silver metallic base lacquer from Example 1 was applied by spraying to give a dry coat thickness of 20 μm. After drying for 3 minutes at 20° C., a commercially available two-component clear lacquer based on acrylate resin was overcoated by spraying to give a dry coat thickness of 35 μm. After forced drying for 30 minutes at 80° C., a metallic coating with a good metallic effect and good flop was obtained.

We claim:

1. A process for the effect coating of polar plastics parts, said parts having a grained surface, comprising:

a) applying a first coating layer, which is free from effect pigments and modified polyolefines, and which comprises a coating medium based on binder vehicle systems that may be dried physically and which contain one or more polyurethane resins and/or oligomeric urethanes and which do not chemically crosslink at 60° to 110° C., at a dry coat thickness of 5 to 40 μm, b) drying at a drying temperature of 20° to 80° C. down to a residual content of 3 to 20% by weight of volatile fractions which are contained in the first coating layer at the drying temperature employed, c) applying a second coating layer by overcoating the first coating layer wet-on-wet with a base lacquer containing effect-pigments, d) drying at a drying temperature of 20° to 80° C. down to a residual content of 3 to 20% by weight of volatile fractions which are contained in the second coating layer at the drying temperature employed, e) applying a third coating layer by overcoating the second coating layer wet-on-wet with a liquid clear lacquer which chemically crosslinks with the formation of covalent bonds at temperatures of 60° to 110° C., and f) jointly drying or hardening the three coating layers at temperatures of 60° to 1100° C.

2. A process according to claim 1, wherein the coating medium is a coating medium for forming a base lacquer coat.

3. A process according to claim 1, wherein the grained surface has a grain of 10 to 50 μm.

4. A process according to claim 1 comprising using a solvent-based coating medium to produce the first coating layer.

5. A process according to claim 4, wherein the coating medium further comprises polyester and/or (meth)acrylic copolymer resins as binder vehicles.

6. A process according to claim 1 comprising using a water-based coating medium to produce the first coating layer.

7. A process according to claim 1, wherein the coating medium contains, as binder vehicles, at least 15% by weight, with respect to the solid resin content of the coating medium, of one or more polyurethane resins and/or oligomeric urethanes.

8. A process according to claim 6, wherein the coating medium further comprises polyester and/or (meth)acrylic copolymer resins as binder vehicles.

9. A process according to claim 1, wherein solid resin compositions of binder vehicles and/or crosslinking agents are qualitatively the same for the first coating layer and for the second coating layer.

10. A process according to claim 1 wherein drying of the first coating layer and the second coating layer is effected under conditions of temperature and time which are below those of the joint drying or hardening of the three coating layers.

11. A process according to claim 1, comprising coating of motor vehicle parts consisting of polar plastics, said polar plastics parts having a grained surface.

* * * * *

UNITED STATES PATENT AND TRADEMARK OFFICE

CERTIFICATE OF CORRECTION

PATENT NO. : 5,747,114

DATED : May 5, 1998

INVENTOR(S) : STEGEN et al.

It is certified that error appears in the above-indentified patent and that said Letters Patent is hereby corrected as shown below:

Column 8, line 13, change "1100° C" to --110° C--; and line 41, change "laver" to --layer--.

Signed and Sealed this

Twenty-seventh Day of October, 1998

*Attest:*

*Attesting Officer*

Bruce Lehman

BRUCE LEHMAN

*Commissioner of Patents and Trademarks*